US010392804B2

(12) United States Patent
Butts et al.

(10) Patent No.: US 10,392,804 B2
(45) Date of Patent: Aug. 27, 2019

(54) DELAY ANCHOR

(71) Applicants: Brian Butts, Conroe, TX (US); Russell Price, Magnolia, TX (US)

(72) Inventors: Brian Butts, Conroe, TX (US); Russell Price, Magnolia, TX (US)

( * ) Notice: Subject to any disclaimer, the term of this patent is extended or adjusted under 35 U.S.C. 154(b) by 0 days.

(21) Appl. No.: 15/948,515

(22) Filed: Apr. 9, 2018

(65) Prior Publication Data

US 2018/0291628 A1 Oct. 11, 2018

Related U.S. Application Data

(60) Provisional application No. 62/483,754, filed on Apr. 10, 2017.

(51) Int. Cl.

| | |
|---|---|
| ***E04C 5/12*** | (2006.01) |
| ***E04C 5/16*** | (2006.01) |
| ***E04G 21/12*** | (2006.01) |

(52) U.S. Cl.

CPC ..... *E04C 5/165* (2013.01); *E04C 5/122* (2013.01); *E04C 5/125* (2013.01); *E04G 21/12* (2013.01)

(58) Field of Classification Search

CPC ..... E04C 5/122; E04C 5/165

See application file for complete search history.

(56) References Cited

U.S. PATENT DOCUMENTS

| | | | | |
|---|---|---|---|---|
| 5,347,777 | A * | 9/1994 | Sudduth | E04C 5/122 52/223.13 |
| 6,151,850 | A | 11/2000 | Sorkin | |
| 6,176,051 | B1 | 1/2001 | Sorkin | |
| 6,761,002 | B1 | 7/2004 | Sorkin | |
| 9,181,967 | B2 * | 11/2015 | Lim | E04C 5/165 |
| 9,840,844 | B2 * | 12/2017 | Prowse | E04C 5/165 |
| 2002/0157333 | A1 * | 10/2002 | Kadotani | E04C 5/08 52/223.2 |
| 2005/0097843 | A1 * | 5/2005 | Giesel | E04C 5/08 52/223.1 |
| 2018/0291628 | A1 * | 10/2018 | Butts | E04C 5/125 |

* cited by examiner

*Primary Examiner* — Andrew J Triggs

(74) *Attorney, Agent, or Firm* — Royal W. Craig; Gordon Feinblatt LLC

(57) ABSTRACT

A delay anchor (delay anchor) for coupling terminal ends of two discontinuous tendons together resulting in a structurally continuous single tendon. The delay anchor generally comprises a coupling sleeve seating one set of tendon wedges for clamping one tendon end, and a stressing barrel seating a second set of tendon wedges for the other tendon end, the stressing barrel being attached to the coupling sleeve, and a compression spring biasing the two assemblies apart. The coupling sleeve is internally configured with a plurality of internal locking channels, and the stressing barrel has a plurality of radially protruding locking lugs slidable therein to provide a twist-lock insertion feature. An encapsulation insert is engaged to one side of an intermediate anchor and an encapsulation sleeve locks onto the encapsulation insert and covers and weather seals all internal components of the delay anchor.

11 Claims, 4 Drawing Sheets

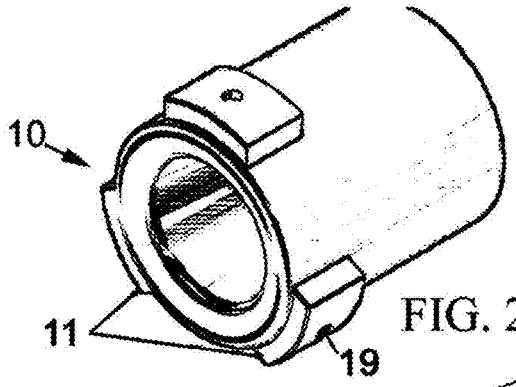
FIG. 2
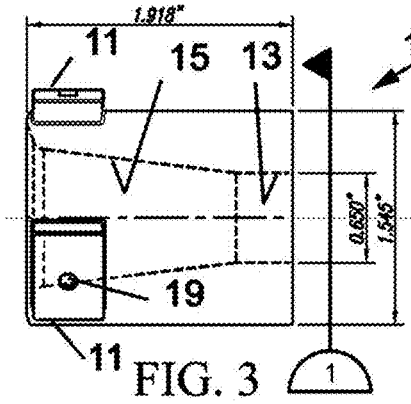
FIG. 3
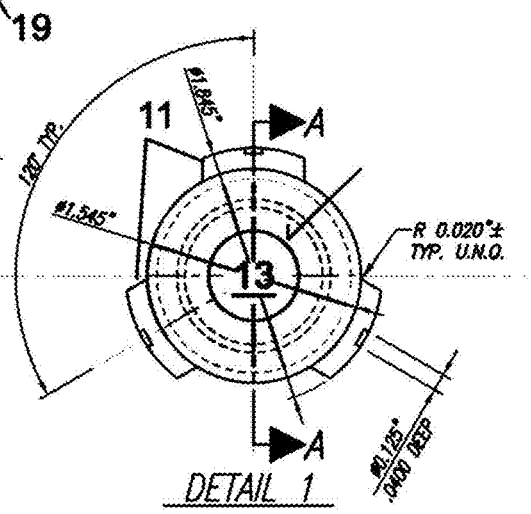
FIG. 4
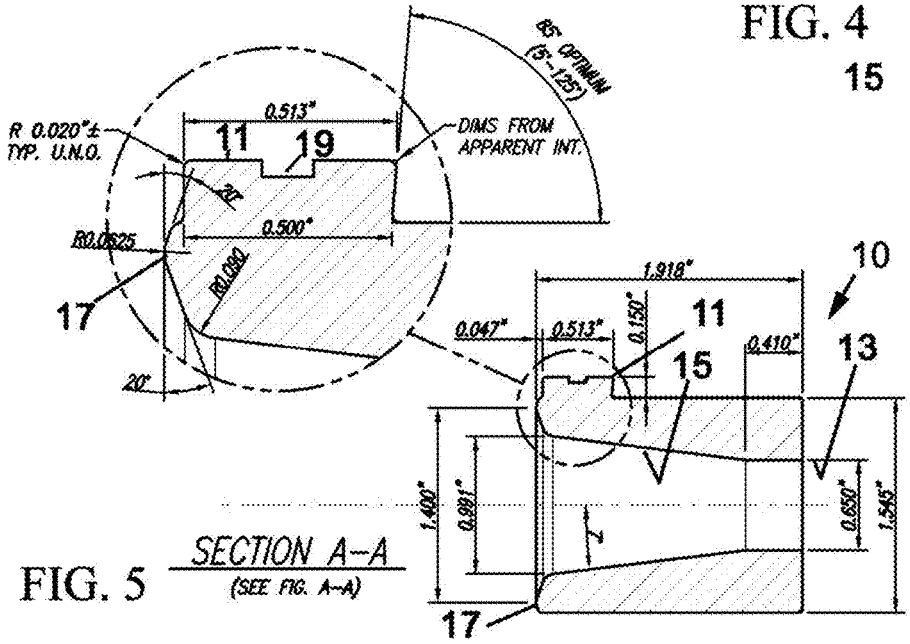
FIG. 5 SECTION A–A
(SEE FIG. A–A)

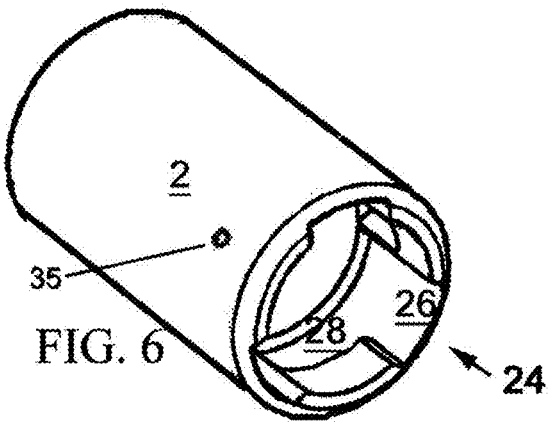
FIG. 6
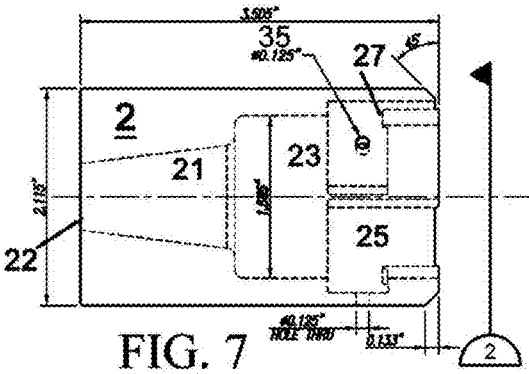
FIG. 7
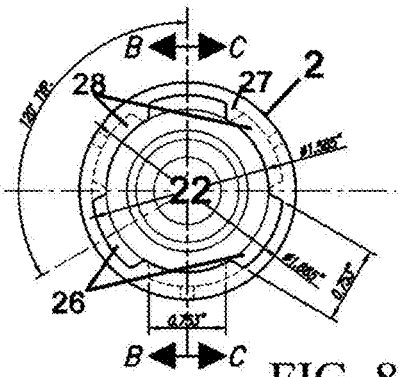
DETAIL 2
FIG. 8
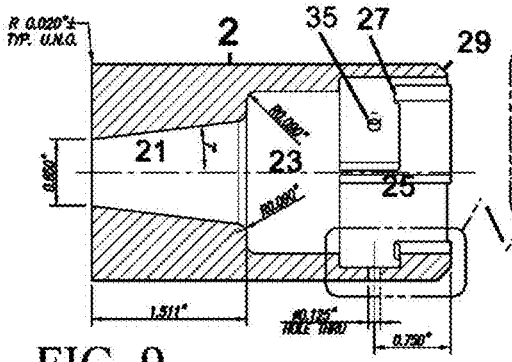
FIG. 9
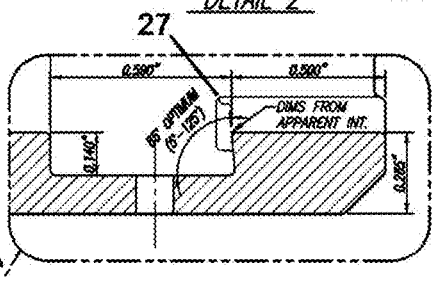
SECTION C–C
(SEE FIG. C–C)
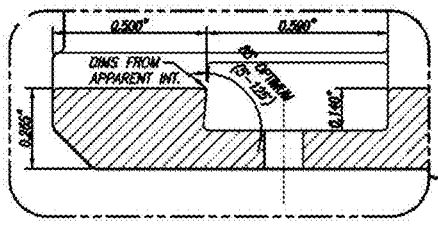
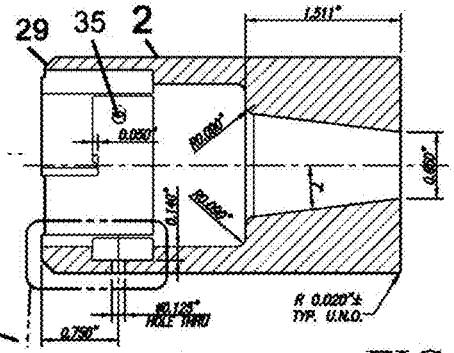
SECTION B–B
(SEE FIG. B–B)
FIG. 10

DELAY ANCHOR

CROSS-REFERENCE TO RELATED APPLICATION(S)

The present application derives priority from U.S. provisional application Ser. No. 62/483,754 filed Apr. 10, 2017.

BACKGROUND OF THE INVENTION

1. Field of the Invention

The present invention relates to post-tension concrete construction and, more particularly, to a delay anchor usable anywhere along the length of a continuous tendon to stress a portion of that tendon and permitting the portion of the tendon to temporarily terminate between adjacent concrete pour phases without requiring the adjacent concrete pour phase to be complete, but subsequently allowing the coupling of different portions of the tendon in the later concrete pour to join the portions of the tendon together to make a structurally continuous tendon.

2. Description of the Background

Post-tensioning concrete entails the use of high-strength steel strand, "tendons," that are embedded in concrete and tensioned after the concrete hardens. Using tendons under tension creates cast-in-place and precast concrete members that have superior strength characteristics when compared to similarly sized non-prestressed members.

In unbonded post-tensioning applications, the steel tendons are first coated with a corrosion preventative friction reducing grease and then encased in a plastic sheathing before being laid into concrete forms. Most tendons have a fixed anchor on one end that is attached to the tendon and that is placed adjacent to the concrete form. The other end of the tendon, also known as the "stressing tail," is passed loosely through a stressing anchor that is affixed to the other end of the concrete form and then extends a fixed distance past the form. After the concrete is placed, cured, and hardened to a specified strength, a hydraulic jack is attached to the stressing tail to apply tension to the tendon. In some conditions a tendon may have stressing anchors on both ends and no fixed end anchor is used.

There are numerous variations on and specialized components for post-tensioning. For example, sometimes concrete is cast in phases, with continuous tendons passing through the multiple phases. There are construction joints between the phases, and intermediate stressing is used for the tendons located at construction joints between phases so that the tendons in separate phases can be tensioned separately and the formwork below each phase removed after it has been tensioned.

After one section of concrete is placed, cured, and hardened to a specified strength in its formwork, a hydraulic jack is attached at some intermediate point along the tendon to apply tension to the tendon. An intermediate anchor may be used in this case, e.g., an anchor located at some intermediate point along the tendon used to stress only a portion of the tendon in a completed concrete section leaving a length of remaining tendon free for later post-stressing in a different section. There are many instances where the need arises to post-stress multiple concrete sections using continuous tendons and those multiple concrete sections are being cast sequentially. For example, a parking ramp portion below an office tower (Phase 1) may be built months before an adjoining exterior ramp portion (Phase 2), yet the tendons must be continuous through both portions. The first phase would be stressed, but in many cases this leaves the unused portion of the tendon sitting out exposed for months until the second phase (exterior ramp) can be poured. The exposure to the elements can over time cause the tendon to corrode and lead to early failure.

There are also components used simply to connect two pieces of tendon together. These are called barrel couplers, splice chucks, or in-line stressing couplers. These components join the unsheathed portion of a first tendon to the unsheathed portion of a second tendon by use of internal wedges, springs and other components.

For example, U.S. Pat. No. 6,761,002 to Sorkin (General Technologies, Inc.) issued Jul. 13, 2004 shows a connector assembly for intermediate post-tension anchorage that splices a first tendon to a second tendon with a set of standard wedges 74 (FIG. 2) seated in respective barrel anchors 56, 76 and biased apart by a rubber grommet 104. The wedges 74, barrel anchors 56, 76 and grommet 104 are contained within a stressing barrel 60. The stressing barrel 60 is a sleeve open on one side, closed on the other, with a tendon-passing hole through the closure. One barrel anchor 56 seats into the closed end of stressing barrel 60, and the other barrel anchor 76 screws into the top of barrel 60. The outward-protruding end of barrel anchor 76 seats into intermediate anchor 78 (a standard encapsulated anchor presently sold by General Technologies, Inc. of Stafford, Tex.). An encapsulation sleeve 62 fits overtop and seals around the outside of the anchor 78.

U.S. Pat. No. 6,176,051 to Sorkin (GTI) issued Jan. 23, 2001 shows a splice chuck for use in a post-tension anchor system with a first collar 54 screwed into a threaded end 50 of a body 4, and a second collar 56 is threadedly received within the threaded end 52 of the body 48. The collars 54 and 56 have tapered interiors 58 and 60, respectively. Wedges 62 and 64 are received within the tapered interior 58 of collar 54. Similarly, wedges 66 and 68 are received within the tapered interior 60 of collar 56.

U.S. Pat. No. 6,151,850 to Sorkin (GTI) issued Nov. 28, 2000 shows an intermediate anchorage system utilizing a splice chuck, and a cover 80 (FIG. 2) extending over the splice chuck. The cover 80 has one end in liquid-tight relationship with the tendon, and it extends to a cap that mates with the encapsulation of the intermediate anchor. The cover includes both a polymeric section and an elastomeric portion. The elastomeric portion overlaps an end of the polymeric portion in liquid-tight relationship therewith. The foregoing barrel couplers, splice chucks, or in-line stressing couplers allow shorter lengths of tendons to be installed in phases and joined end-to-end. Then at the next phase or "pour" the concrete can be poured over the tendons and the coupler. Unfortunately, because of the use of threaded collars these prior art barrel couplers, splice chucks, or in-line stressing couplers are difficult to assemble in the field. In addition, they are susceptible to failure and particularly susceptible of corrosion and deterioration. The weakening of any component within the splice chuck can compromise the overall integrity of the splice chuck and, possibly, release the end of one tendon from the end of an adjoining tendon and compromise a joint in the concrete structure.

It would be greatly advantageous to provide a delay anchor that allows the tendon from one phase of construction to be terminated at a joint between a next phase of construction, fully protected from the elements, and then coupled to a remaining portion of the tendon more easily. For this the delay anchor must be simple to assemble in the field, not prone to corrosion or deterioration, and stronger and more robust than prior art devices.

SUMMARY OF THE INVENTION

It is, therefore, an object of the present invention to provide a delay anchor that allows a tendon from one phase of construction to be terminated at a joint adjoining the next phase of construction, protected there from the elements, and later coupled to a remaining portion of the tendon.

It is another object to provide a delay anchor that is economical to produce, simple to assemble in the field, not prone to corrosion or deterioration, and stronger and more robust than prior art devices.

According to the present invention, the above-described and other objects are accomplished by a delay anchor for anchoring terminal ends of a first tendon to a second tendon at a construction joint. The delay anchor generally comprises a coupling sleeve seating a first set of tendon wedges, and a stressing barrel seating a second set of tendon wedges and engaged to the coupling sleeve, and a compression spring biasing the wedge-sets apart. The coupling sleeve is internally configured at its open mouth with a plurality of internal locking channels, and the stressing barrel has a plurality of radially protruding locking lugs corresponding to the locking channels of the coupling sleeve and slidable therein to provide a twist-lock insertion feature. An encapsulation insert is engaged to the receptacle of the anchor as to form a liquid-tight seal therewith, and one of an encapsulation cap or encapsulation sleeve is coupled to the encapsulation insert. Thus, at the end of the first phase or pour, the end of the tendon passes from that phase outward through an intermediate anchor. The encapsulation insert is installed on the end, then the stressing barrel, a first set of wedges are inserted onto the tendon and seated in the stressing barrel, and the anchor is stressed in a conventional manner and left in place. The delay anchor includes an encapsulation cap for long term delays, which slides over and seals the protruding end of the stressed tendon, covering the stressing barrel, and engages the encapsulation insert to seal the assemblage. After an appropriate delay a collar seal is inserted onto the subsequent pour tendon end, followed by the aforementioned encapsulation sleeve, a foam insert and then by the coupling sleeve. The subsequent pour tendon end is anchored in the coupling sleeve by a second set of tendon wedges seated therein. This subsequent pour assembly inclusive of encapsulation sleeve, foam insert, coupling sleeve, compression spring and second set of tendon wedges may be assembled at the manufacturing facility. On site the encapsulation cap is disengaged from the encapsulation insert and removed from the encapsulation insert and first tendon, leaving the stressing barrel exposed. The coupling sleeve is engaged to the stressing barrel joining the two tendons together, and is twist-locked in place. Finally, the encapsulation sleeve is received over the foregoing components and twist-locked onto the encapsulation insert. The encapsulation sleeve has a tubular extension protruding over the second tendon end, and the collar seal is screw-engaged to the tubular extension of the encapsulation sleeve to seal it to the sheathing of the second tendon. A like collar seal may be used on the other side of the intermediate anchor to seal the sheathing of the first tendon thereto.

BRIEF DESCRIPTION OF THE DRAWINGS

Other objects, features, and advantages of the present invention will become more apparent from the following detailed description of the preferred embodiments and certain modifications thereof when taken together with the accompanying drawings in which:

FIG. 2 is a perspective view of the stressing barrel used in the delay anchor of FIG. 1.

FIG. 3 is a side view of the stressing barrel of FIG. 2.

FIG. 4 is an end view of the stressing barrel of FIGS. 2-3.

FIG. 5 is a side cross-section of the stressing barrel of FIGS. 2-4 with enlarged inset showing dimensions of a locking lug.

FIG. 6 is a perspective view of the coupling sleeve with locking channels used in the delay anchor of FIG. 1.

FIG. 7 is a side view of the coupling sleeve with locking channels of FIG. 6.

FIG. 8 is an end view of the coupling sleeve with locking channels of FIGS. 6-7.

FIG. 9 is a side cross-section of the coupling sleeve with locking channels of FIGS. 6-8 with enlarged inset showing dimensions at one cross-section of the locking channel.

FIG. 10 is a side cross-section of the coupling sleeve with locking channels of FIGS. 6-8 with enlarged inset showing dimensions at another cross-section of the locking channel.

DETAILED DESCRIPTION OF THE PREFERRED EMBODIMENT

Figure 1:
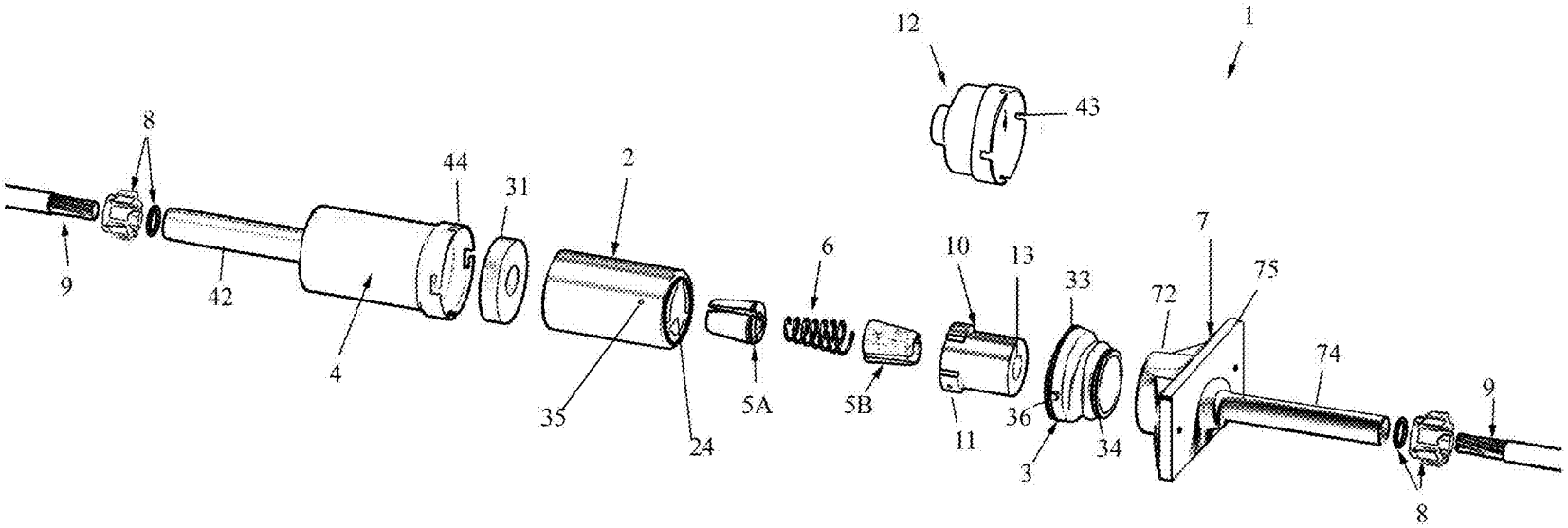
FIG. 1 is a perspective assembly view of a delay anchor according to an embodiment of the invention.

The present invention according to a preferred embodiment of the invention and as shown in FIG. 1 is a delay anchor 1 for anchoring terminal ends of a discontinuous tendon 9 at a concrete construction joint. The delay anchor 1 generally comprises a coupling sleeve 2 open at one (exposed) end, and partially closed at the other end except for a central through hole 22 (obscured in FIG. 1) conforming in size to pass the discontinuous end of sheathed tendon 9. The coupling sleeve 2 is internally configured with a frusto-conical recess 21 (to be described) tapering down to through-hole 22 for seating and compressing a first set of tendon wedges 5A inserted therein. The coupling sleeve 2 is also internally configured at its open mouth with a plurality of internal locking channels 24 that provide a twist-lock insertion feature for a stressing barrel 10. The stressing barrel 10 is an annular member sized for slidably receipt into the mouth of coupling sleeve 2, and formed with a corresponding plurality of external radial lugs 11 each of which slide into one of the plurality of internal L-shaped channels 24 of coupling sleeve 2 to provide the twist-lock insertion feature. The stressing barrel 10 is also open at one (obscured) end and partially closed at the other (exposed) end except for a central through hole 13 sized to pass the discontinuous end of sheathed tendon 9. The stressing barrel 10 is likewise internally configured with an internal frusto-conical internal recess IS (obscured in FIG. 1) tapering down to the through-hole 13 for seating and compressing a second set of tendon wedges 5B inserted therein. A short compression spring 6 is inserted between the tendon wedges 5A, 5B to maintain separation. One skilled in the art will understand that the tendon wedges 5A, 5B may be conventional pieces of tapered high-strength heat-treated steel with inner serrations (teeth) that penetrate the prestressing tendon steel. It is well-known to use two-part wedges or three-part wedges, and so by "tendon wedges" any number or design of wedge pieces is intended. When the coupling sleeve 2 (attached to unsheathed portion of tendon 9 with second set of tendon wedges 5A) is slid over the stressing barrel 10 (attached to unsheathed portion of tendon 9 with first set of tendon wedges 5B) and twisted to lock position, the spring 6 biases the coupling sleeve 2 and the stressing barrel 10 apart, ensuring they stay in the locked position. The stressing barrel 10 is received within an encapsulation insert 3, and the encapsulation insert 3 is inserted into the anchor 7 and anchored therein by screw-threads. The preferred anchor 7 is an encapsulated intermediate anchor having a threaded socket receptacle 72 on one side separated from a tubular extension 74 on the other side by a flange 75. Note that the juncture between threaded socket receptacle 72 and flange 75 is preferably reinforced by radial struts. The tendon 9 extends into the tubular extension 74 and out through the socket receptacle 72. The encapsulation insert 3 has a small mouth rimmed with an O-ring 34 that is received in the socket receptacle 72 of anchor 7 so as to form a liquid-tight seal there between. The encapsulation insert 3 also has a large mouth rimmed with an O-ring 33 and a plurality of axially-protruding lugs 36 that are captured in encapsulation sleeve 4 preferably by twist-lock, the square lugs 36 being captured in L-shaped notches 44 in encapsulation sleeve 4. Alternatively, the encapsulation insert 3 may be temporarily fitted with the encapsulation cap 12 during delays between adjacent phases as described below, and in this case the axially-protruding lugs 36 are captured in encapsulation cap 12 preferably by snap-fit because twist-lock may have a tendency to unscrew the encapsulation insert 3 upon removal. For snap fit the square lugs 36 are captured and held captive in conforming notches 43 in encapsulation cap 12. Either way, with encapsulation cap 12 or encapsulation sleeve 4, a water tight seal is formed with the encapsulation insert 3 via O-ring 33. In the case of a long-term delay between adjacent phases, the temporary encapsulation cap 12 slides over the protruding end of the stressed tendon 9 at right, covering the installed stressing barrel 10, and slides onto the encapsulation insert 3 seated in the socket receptacle 72 of anchor 7. The encapsulation cap 12 is received over the encapsulation insert 3 and attaches by snap-fit of lugs 36 into notches 43 so as to form a liquid-tight seal there between with O-ring 33 during the long-term delay.

After the appropriate delay and before placing concrete for the second phase, the temporary encapsulation cap 12, if used, is removed and the larger encapsulation sleeve 4 is used. A foam doughnut/insert 31 is inserted into the encapsulation sleeve 4 and the discontinuous end of tendon 9 is inserted through a screw-collar/O-ring combination 8 into the tubular extension 42 of encapsulation sleeve 4, through foam insert 31 and is anchored by the first set of tendon wedges 5A in coupling sleeve 2. The encapsulation sleeve 4 covers the entire stressing barrel 10/foam insert 31/coupling sleeve 2/wedges 5/spring 6 combination, engaging the encapsulation insert 3 by twist-lock connection. The encapsulation sleeve 4 is received over the encapsulation insert 3 so as to form a liquid-tight seal there between with O-ring 33, and twist locks onto lugs 36 of encapsulation insert 3. The encapsulation sleeve 4 extends to a tubular extension 42, and the end of tendon 9 (left) extends into the tubular extension 42. In order to ensure a liquid-tight seal of the tubular extension 42 with the sheathing of tendon 9, a screw-collar and O-ring 8 combination is applied. An identical screw-collar/O-ring 8 may be applied to the end of the intermediate anchor 7 tubular extension 74 during the first phase of construction.

In the illustrated preferred embodiment, the anchor 7 is a commercially-available Precision Hayes International Posi-Lock Plus® encapsulated anchor, though one skilled in the art should understand that any of a variety of encapsulated or non-encapsulated anchors or plates can be used. The Precision Hayes encapsulated intermediate anchor 7 comes with threads molded into the encapsulation of the socket receptacle 72 to accept a Precision Hayes intermediate pocket former spindle (not shown). The present encapsulation insert 3 is externally threaded to use these same threads. The screw-collars with O-rings 8 are also commercially available components from Precision Hayes International and others.

The encapsulation insert 3 provides a water tight seal between itself and the Precision Hayes encapsulated intermediate anchor 7 via O-ring 34. The encapsulation insert 3 also provides a twist-lock and/or snap fit engagement for the encapsulation sleeve 4 or encapsulation cap 12 as described above, both engagements implemented with a plurality of axially-protruding lugs 36 on encapsulation insert 3 and appropriate notches 44 or 43 in encapsulation sleeve 4 or cap 12, respectively. This way, a water tight seal is formed between the encapsulation insert 3 and the encapsulation sleeve 4 or cap 12 via O-ring 33 secured by the twist-lock engagement and/or snap fit engagement. Both sets of tendon wedges 5A, 5B may be conventional 2-part 1.2 wedges, 3-part 1.2 wedges, or any other number, configuration or design of wedge pieces.

In use in the field, with formwork in place but prior to the first phase or pour, the end of the tendon 9 at right passes through the screw-collar/O-ring 8 combination and through the anchor 7 such that the unsheathed end protrudes outward to the left of the socket receptacle 72 (FIG. 1). After concrete has been poured, reached the specified stressing strength and edge form removed, the encapsulation insert 3 is installed on the end of tendon 9 and threaded into intermediate anchor 7, then the stressing barrel 10 is installed, then tendon wedges 5B are inserted onto the tendon 9 and seated in the stressing barrel 10 to anchor the tendon 9.

The end of tendon 9 may be stressed and cut in a conventional manner after the first phase is poured.

The encapsulation cap 12 is installed as described above for long term delays, and this slides over and seals the remaining protruding end of the stressed tendon 9, covering the stressing barrel 10, and engaging the encapsulation insert 3 to seal this portion of the assemblage.

After the formwork for the second phase is in place at the construction joint, a second discontinuous tendon 9 end protrudes (far left). This end of tendon 9 is passed through the opposing screw-collar/O-ring 8 combination and through the encapsulation sleeve 4/foam insert 31 and coupling sleeve 2 such that the unsheathed end protrudes outward through tendon wedges 5A. The complete second tendon 9/screw-collar/O-ring 8/encapsulation sleeve 4/foam insert 31/coupling sleeve 2/wedges 5A/compression spring 6 are typically seated in the fabrication facility and shipped on the second tendon 9.

The encapsulation cap 12 is disengaged from the encapsulation insert 3 and removed from the intermediate anchor 7 and end of tendon 9, leaving the stressing barrel 10 exposed.

The coupling sleeve 2 is inserted onto the stressing barrel 10 and twist-locked in place. The encapsulation sleeve 4 likewise has a twist-lock lip and it is inserted over the foam insert 31, coupling sleeve 2, stressing barrel 10, compression spring 6 and wedges 5A and 5B in combination and twisted onto the encapsulation insert 3. Finally, the collar seal and O-ring 8 is screw-engaged to the tubular extension 42 of the encapsulation sleeve 4 to seal it to the sheathing of the second tendon 9 end.

This way, the delay anchor 1 allows the tendon 9 from a first phase of construction to be terminated and post-stressed outside the anchor 7 to allow for easier installation, relieves the formwork and shoring of the first phase, and eliminates the bulky, labor intensive coil of continuous tendon to be used in the adjacent second phase. In addition, this provides a means of protecting the anchorage from corrosion (after stressing) should there be a delay in the construction of the adjacent second phase.

FIG. 2 is a perspective view, FIG. 3 a side view, and FIG. 4 is an end view of the stressing barrel 10. The stressing barrel 10 is open at one (FIG. 2) end and partially closed at the other (FIG. 4) end except for through hole 13. Dimensions are shown in inches and radiussed corners or edges R are shown in degrees. The stressing barrel 10 is formed with a plurality of external locking lugs 11 each of which slide into one of the plurality of internal channels 24 of coupling sleeve 2 to provide the twist-lock insertion feature. Preferably, three such lugs 11 are provided and protrude radially at 120 degree intervals about stressing barrel 10. One skilled in the art should understand that two lugs at 180 degree intervals or four or more lugs 11 will also suffice.

As seen in dotted lines in FIGS. 3-4, the stressing barrel 10 is internally configured with a frusto-conical recess 15 opening toward the open mouth and tapering down to the through-hole 13. Exemplary dimensions, for example, are as follows: through hole is a constant 0.650 inches diameter, the diameter of the stressing barrel 10 annulus is 1.545 inches, the length of stressing barrel 10 is 1.918 inches, and so the frusto-conical recess 15 extends over approximately 1.5 inches at a surface incline within a range of from 4-10 degrees, optimally at approximately 7 degrees. This securely seats and compresses a standard 2-part 1.2 pair or 3-part 1.2 set of tendon wedges 5B inserted therein. The stressing barrel 10 is received within the encapsulation insert 3 by simple insertion. The stressing barrel 10 is held in place against the intermediate anchor 7 by tension in the first phase pour.

The relative size, dimensions and chamfers of the locking lugs 11 are important for ease of assembly and strength in the field. FIG. 5 is a side cross-section of the stressing barrel 10 of FIGS. 2-4 with enlarged inset showing dimensions of an exemplary locking lug 11. Note that the lip 17 of the stressing barrel 10 is beveled at approximately 20 degrees on either side as shown to facilitate the hydraulic jack to center on the stressing barrel 10 during stressing. The locking lugs 11 preferably occupy between one quarter and one half the circumference of the stressing barrel 10 and conform to the arc of the stressing barrel 10 for maximum strength and ease of engagement, and in the illustrated embodiment are approximately three quarter inch side-to-side, approximately one half inch deep, and protrude radially outward approximately 0.150" at equi-angular 120 degree intervals (larger or smaller if fewer or more locking lugs 11 are used). The outermost edges of the lugs 11 are rounded at a 0.020" radius. As seen in the inset to FIG. 5 each locking lug 11 is defined by a central exterior circular recess 19. These recesses 19 are used as a visual indication to show that the stressing barrel 10 and coupling sleeve 2 are properly locked in place when recess 19 are visually seen through hole 35 on coupling sleeve 2. Importantly, and as seen in the inset (FIG. 5), the trailing edge of each locking lug 11 is canted at an angle within a range of from 5-125 degrees, 85 degrees being optimal. When the stressing barrel 10 is pulled into the coupling sleeve 2 by the tendon 9, this angle imparts a radial force to the mouth of stressing barrel 10 and ensures a more robust engagement.

FIG. 6 is a perspective view, FIG. 7 a side view, and FIG. 8 is an end view of the coupling sleeve 2. The coupling sleeve 2 is open at one (FIG. 6) end and partially closed at the other (FIG. 8) end except for through hole 22. Dimensions are again shown in inches and radiussed corners in degrees. The coupling sleeve 2 is formed with a plurality of internal locking channels 24 at its open end to provide the twist-lock insertion feature for the locking lugs 11 of stressing barrel 10. Each locking channel 24 is configured as an L-shaped groove with an axial portion 26 leading inward for slidable insertion of a corresponding lug 11 and a radial portion 28 providing the twist-lock insertion feature. Given three such lugs 11, three corresponding locking channels 24 are provided and are equi-angularly spaced at 120 degree intervals within the mouth of coupling sleeve 2. Given fewer or more lugs 11 at varying degree intervals fewer or more locking channels 24 are likewise provided.

As seen in dotted lines in FIG. 7, the coupling sleeve 2 is internally configured with a compound interior including a frusto-conical recess 21 tapering down to the through-hole 22, and opening to a larger central chamber 23 of uniform cross-section, plus a larger locking chamber 25 adjoining the central chamber 23 and containing the locking channels 24. Exemplary dimensions, for example, are as follows: the through hole begins at 0.650 inches diameter, the diameter of the coupling sleeve 2 annulus is 2.115 inches, and the overall length of coupling sleeve 2 is 3.505 inches. The frusto-conical recess 21 extends over approximately 1.511 inches at a surface incline within a range of from 4-10 degrees, and optimally at approximately 7 degrees. This again securely seats and compresses a standard 2-part 1.2 pair or 3-part 1.2 set of tendon wedges 5A inserted therein. The larger central chamber 23 is of uniform 1.585" diameter and extends approximately 0.9 inches between recess 21 and locking chamber 25. The internal edges of central chamber 23 are radiussed as shown.

As seen in FIG. 8, each locking channel 24 comprises an axial portion 26 of approximately 0.753 inch width leading inward for slidable insertion of a corresponding lug 11, the axial portion 26 communicating with a radial portion 28 of approximately 0.753 inch width for seating the lug 11 and providing the twist-lock insertion feature. Note in FIGS. 7-8 that the axial portion 26 and radial portion 28 are separated by a shoulder 27 for capturing the seated lug 11 and locking it in place. As seen in FIG. 8, given three lugs 11, three corresponding locking channels 24 are provided and are equi-angularly spaced at 120 degree intervals within the mouth of coupling sleeve 2.

The features and relative size, dimensions and chamfers of the locking channels lugs 11 are important for ease of assembly and strength in the field. FIG. 9 is a side cross-section of the coupling sleeve 2 of FIGS. 6-8 with enlarged inset taken at section C-C showing dimensions of an exemplary locking channel 24. FIG. 10 is a side cross-section of the coupling sleeve 2 of FIGS. 6-8 with enlarged inset taken at section B-B showing dimensions of an exemplary locking channel 24. Note that the lip 29 of the coupling sleeve 2 is beveled at approximately 45 degrees to facilitate insertion into encapsulation insert 3 and allow proper clearance for the twist lock to engage. The axial portion 26 is approximately 1.090 inches front-to-back and 0.140 inches deep, and radial portion 28 past shoulder 27 is approximately 0.590 inches front-to-back and 0.140 inches deep, widthwise dimensions stated earlier, in all cases annularly conforming to the interior arc of the coupling sleeve 2. The shoulder 27 for capturing the seated lug 11 and locking it in place is an approximate 0.125 inch protrusion at the elbow of the radial portion 28 and axial portion 26. As with the lugs 11, the inner edges of the locking channels 24 are rounded at a 0.020"

radius as shown. Preferably, a circular through hole 35 is provided through the coupling sleeve 2 wall into the center of the radial portion 28 of the locking channels 24, thereby conforming to the central exterior circular recess 19 of the lugs 11 of stressing barrel 10. This is used as a visual indication to show that the stressing barrel 10 and coupling sleeve 2 are properly locked in place when recess 19 is visually seen through hole 35 on coupling sleeve 2. Importantly, and as seen in the insets (FIGS. 8-9, the leading edge of each radial portion 28 is canted at an angle conforming to that of the corresponding locking lugs 11, e.g., within a range of from 5-125 degrees, 85 degrees being optimal. This way, when the stressing barrel 10 is locked into the coupling sleeve 2 and compressed by the force of the tendon 9, it imparts a radial force to the mouth of coupling sleeve 2 and ensures a more robust engagement.

Referring back to FIG. 1, the encapsulation sleeve 4 is preferably a molded plastic component shaped with a three-tier inner diameter as shown including a tubular neck section 42 which will extend in close relationship over the sheathed portion of the tendon 9, a larger diameter body portion to cover and conform to the exterior of the conjoined coupling sleeve 2 and stressing barrel 10, and a flared rim portion with notches 44 for twist-lock mating with the encapsulation insert 3. The encapsulation sleeve 4 is received over the encapsulation insert 3 so as to form a liquid-tight seal there between with O-ring 33, and twist locks onto encapsulation insert 3.

The encapsulation cap 12 is likewise a molded plastic component shaped with a three-tier inner diameter, similar to the encapsulation sleeve 4 but shorter including a truncated neck to slip over the unsheathed portion of the end of tendon 9. Encapsulation cap 12 also has an identical flared rim portion with notches 43 for mating with the encapsulation insert 3. The encapsulation cap 12 is received over the encapsulation insert 3 so as to form a liquid-tight seal there between with O-ring 33, and slides onto encapsulation insert 3 with a snap-fit engagement.

Figure 11:
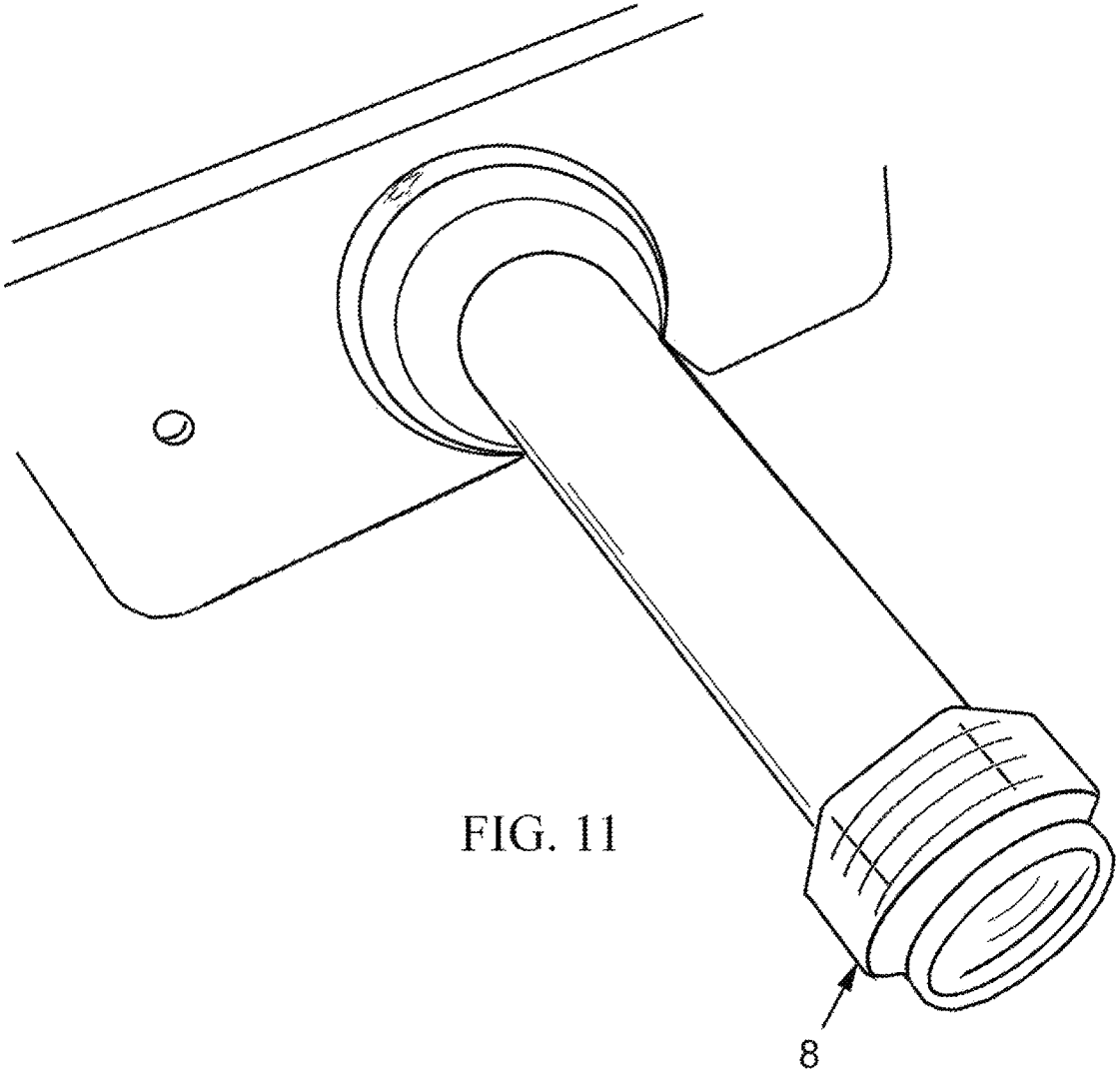
FIG. 11 is a perspective view of the screw-grip terminal cap with O-ring for sealing the encapsulation sleeve of the intermediate end anchorage of FIG. 1.

FIG. 11 is a close-up perspective view of an exemplary screw-collar with O-ring 8 (commercially available component from Precision Hayes International and others) here twisted onto the neck of the intermediate anchor 7, an identical twin being twisted onto the protruding neck section 42 of encapsulation sleeve 4 for sealing it.

In sum, the above-described delay anchor 1 allows a tendon from one phase of construction to be terminated at a joint adjoining the next phase of construction, sealed and protected there from the elements, and later coupled to a remaining portion of the tendon thereby resulting in a continuous tendon throughout the two phases.

Moreover, the delay anchor 1 is economical to produce, simple to assemble in the field, not prone to corrosion or deterioration, and stronger and more robust than prior art devices.

We claim:

1. A delay anchor for anchoring terminal ends of a discontinuous tendon at a concrete construction joint, comprising:

an anchor having a receptacle;

an encapsulation insert inserted into the receptacle of said anchorage assembly;

a coupling sleeve open at one end and constricted at another end to a through hole for passing one tendon encl. said coupling sleeve having a conical interior recess tapering from said open end toward said through-hole, and a plurality of internal locking channels at said open end;

a first set of tendon wedges seated in the conical interior recess of said coupling sleeve;

a stressing barrel inserted through said encapsulation insert and into the receptacle of said anchorage assembly, said stressing barrel being open at one end and constricted at another end to a through hole for passing another tendon end, said stressing barrel having a conical interior recess tapering from said open end toward said through-hole, and said stressing barrel being formed with a plurality of external radial lugs each of which slide into one of the plurality of internal channels of said coupling sleeve to provide a twist-lock engagement; and a second set of tendon wedges seated in the conical interior recess of said stressing barrel.

2. The delay anchor according to claim 1, wherein said encapsulation insert further comprises screw threads for engagement with the anchor.

3. The delay anchor according to claim 1, wherein said encapsulation insert further comprises a first O-ring for sealing engagement with the anchor.

4. The delay anchor according to claim 3, wherein said encapsulation insert further comprises a second O-ring.

5. The delay anchor according to claim 1, further comprising a compression spring for biasing apart said second set of tendon wedges and said first set of tendon wedges.

6. The delay anchor according to claim 1, further comprising an encapsulation sleeve covering all of said stressing barrel, coupling sleeve, first set of wedges and second set of wedges, and engaged to the encapsulation insert.

7. The delay anchor according to claim 6, wherein said encapsulation sleeve is configured to be secured to the encapsulation insert by twist-lock connection.

8. The delay anchor according to claim 6, further comprising a foam insert inside said encapsulation sleeve.

9. The delay anchor according to claim 6, wherein said encapsulation sleeve comprises a tubular extension sealed about said first tendon end with a screw-collar.

10. The delay anchor according to claim 1, further comprising an encapsulation cap engaged to the encapsulation insert.

11. The delay anchor according to claim 10, wherein said encapsulation cap is configured to be secured to the encapsulation insert by snap-fit connection.

* * * * *